US008431297B2

(12) United States Patent
Shin et al.

(10) Patent No.: US 8,431,297 B2
(45) Date of Patent: Apr. 30, 2013

(54) ELECTROPHOTOGRAPHIC TONER AND METHOD OF PREPARING THE SAME

(75) Inventors: Yo-Da Shin, Incheon Metropolitan (KR); Jun-Young Lee, Seoul (KR); Jae-Hwan Kim, Seoul (KR); Tae-Hoe Koo, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 604 days.

(21) Appl. No.: 12/580,751

(22) Filed: Oct. 16, 2009

(65) Prior Publication Data

US 2010/0143835 A1 Jun. 10, 2010

(30) Foreign Application Priority Data

Dec. 8, 2008 (KR) ..... 10-2008-0124297

(51) Int. Cl.
*G03G 9/00* (2006.01)

(52) U.S. Cl.
USPC ..... 430/108.3; 430/108.1; 430/108.8

(58) Field of Classification Search ..... 430/108.1, 430/108.8, 110.1, 110.3, 108.3
See application file for complete search history.

(56) References Cited

U.S. PATENT DOCUMENTS

| | | | | |
|---|---|---|---|---|
| 6,337,169 | B1 * | 1/2002 | Hashimoto et al. | 430/110.1 |
| 6,838,220 | B2 * | 1/2005 | Matsumura et al. | 430/110.3 |
| 2004/0009420 | A1 * | 1/2004 | Sugahara et al. | 430/108.1 |
| 2009/0111038 | A1 * | 4/2009 | Shin et al. | 430/48 |

* cited by examiner

*Primary Examiner* — Stewart Fraser
(74) *Attorney, Agent, or Firm* — Stanzione & Kim, LLP

(57) ABSTRACT

Provided are an electrophotographic toner and a method of preparing the same. The toner includes a latex, a coloring agent, and a release agent, and has a selected amount of wax exposed on the surface of the toner.

6 Claims, 6 Drawing Sheets

ELECTROPHOTOGRAPHIC TONER AND METHOD OF PREPARING THE SAME

CROSS-REFERENCE TO RELATED PATENT APPLICATION

This application claims the benefit of Korean Patent Application No. 10-2008-0124297, filed on Dec. 8, 2008, in the Korean Intellectual Property Office, the disclosure of which is incorporated herein in its entirety by reference.

TECHNICAL FIELD

The disclosure relates generally to an electrophotographic toner and a method of preparing the same, and more particularly, to an electrophotographic toner having a controlled amount of wax exposed on the surface of the toner, and to a method of preparing the toner.

BACKGROUND OF RELATED ART

Toner can be prepared by pulverization or polymerization. According to the pulverization method, toner is prepared by melting and mixing synthetic resins with pigments and, if required, other additives, pulverizing the mixture, and sorting particles until particles of a desired size are obtained. According to the polymerization method, a polymerizable monomer composition is manufactured by uniformly dissolving or dispersing various additives such as a pigment, a polymerization initiator and, if required, a cross-linking agent and an antistatic agent in a polymerizable monomer. Then, the polymerizable monomer composition is dispersed in an aqueous dispersive medium, which includes a dispersion stabilizer, using an agitator to shape minute liquid droplet particles. Subsequently, the temperature is increased and suspension polymerization is performed to obtain polymerized toner having colored polymer particles of a desired size.

Conventionally, toner used in an image forming apparatus is usually obtained using pulverization. According to the pulverization, the particle size, geometric size distribution, and structure of toner may not be precisely controlled, and thus major properties of toner such as charging properties, fixing properties, fluidity, or storage properties may not be independently designed.

Polymerized toner has been highlighted recently. The size of polymerized toner particles may be easier to control and a complex manufacturing process such as sorting may not be necessary. That is, when toner is prepared through polymerization, polymerized toner having a desired particle size and geometric size distribution may be obtained without pulverizing or sorting. As an example of polymerization, a method of preparing a toner using a metal salt, such as $MgCl_2$ or NaCl, as an agglomerating agent may be used to uniformly control the particle size and shape of the toner. Furthermore, a method of controlling the structure of capsule type toner by controlling agglomeration of the toner may be used in order to increase durability, i.e., charging properties, and storage properties at high temperature.

SUMMARY OF DISCLOSURE

According to an aspect of the disclosure there is provided an electrophotographic toner comprising a latex, a coloring agent and a release agent. The area of a region protruding by a distance of about 100 nm or more in height from the surface of the toner (R) may be in the range of about 5 to about 15% of the total surface area of the toner when an image projection plane of the electrophotographic toner is analyzed using a scanning electron microscope (SEM).

According to another aspect of the disclosure there is provided a method of preparing an electrophotographic toner. The method may include: preparing a mixture by mixing first latex particles including a wax with a pigment dispersion; preparing a first agglomerated toner by adding an agglomerating agent to the mixture; and preparing a second agglomerated toner by coating a second latex on the first agglomerated toner. The area of a region protruding by a distance of about 100 nm or more in height from the surface of the toner (R) may be in the range of about 5 to about 15% of the total surface area of the toner when an image projection plane of the electrophotographic toner is analyzed using a scanning electron microscope (SEM).

According to another aspect of the disclosure, there is provided a toner supplying unit that may include: a toner tank storing a developer including the electrophotographic toner; a supplying part projecting inside the toner tank to discharge the toner from the toner tank; and a toner agitating member rotatably disposed inside the toner tank to agitate the toner in almost an entire inner space of the toner tank including a location on a top surface of the supplying part.

According to another aspect of the disclosure, there is provided an image forming apparatus that may include: an image carrier; an image forming unit that forms an electrostatic latent image on a surface of an image carrier; a unit receiving a developer including the toner; a toner supplying unit that supplies the toner onto the surface of the image carrier to develop the electrostatic latent image on the surface of the image carrier into a toner image; and a developer transferring unit that transfers the toner image to a transfer medium from the surface of the image carrier.

BRIEF DESCRIPTION OF THE DRAWINGS

Various features and advantages of the disclosure will become more apparent by describing in detail several embodiments thereof with reference to the attached drawings in which.

DETAILED DESCRIPTION OF SEVERAL EMBODIMENTS

The disclosure will now be described more fully with reference to the accompanying drawings, in which several embodiments are shown.

An electrophotographic toner according to an embodiment of the disclosure may include a latex, a coloring agent and a release agent. When an image projection plane of the electrophotographic toner is analyzed using a scanning electron microscope (SEM), the area of a region protruding by about 100 nm or more in height from the surface of the toner (R) is in the range of about 5 to about 15% of the total surface area of the toner.

According to polymerization by which the particle size and the particle size distribution of toner may be controlled, durability may increase by controlling the toner to have a core/shell capsule structure. Wax may be exposed on the surface of the toner to increase glossiness and fixing areas. However, if the wax is excessively exposed on the surface of the toner due to too high compatibility with a latex resin, charge stability, fluidity and/or thermal stability may decrease. Thus, the amount of the wax exposed on the surface of the toner may need to be precisely measured and controlled in order to prepare toner having sufficient fixing properties and durability.

According to an embodiment of the disclosure, as a simple and precise index, the area of a region protruding by a distance of about 100 nm or more in height from the surface of the toner (R) as a percentage of the total surface area (S) of the toner may be used to measure the amount of wax exposed on the surface of the toner. The protrusion is formed mainly by the wax exposed on the surface of the toner, and thus durability and fixing properties of the toner may be increased by controlling the index.

The area of a region protruding from the surface of the toner (R) as a percentage of the total surface area of the toner may be calculated as follows. First, the total surface area (S) of a toner particle is calculated from an image projection plane of the toner using a scanning electron microscope (SEM). Then, regions protruding by a distance of about 100 nm or more in height from the surface of the toner are selected, and the area of the protrusions (Ai) is calculated. In this regard, the area (R) may be obtained using Equation 1 as follows.

$$R = \frac{\sum_i Ai}{S} \qquad \text{Equation 1}$$

Figure 3:
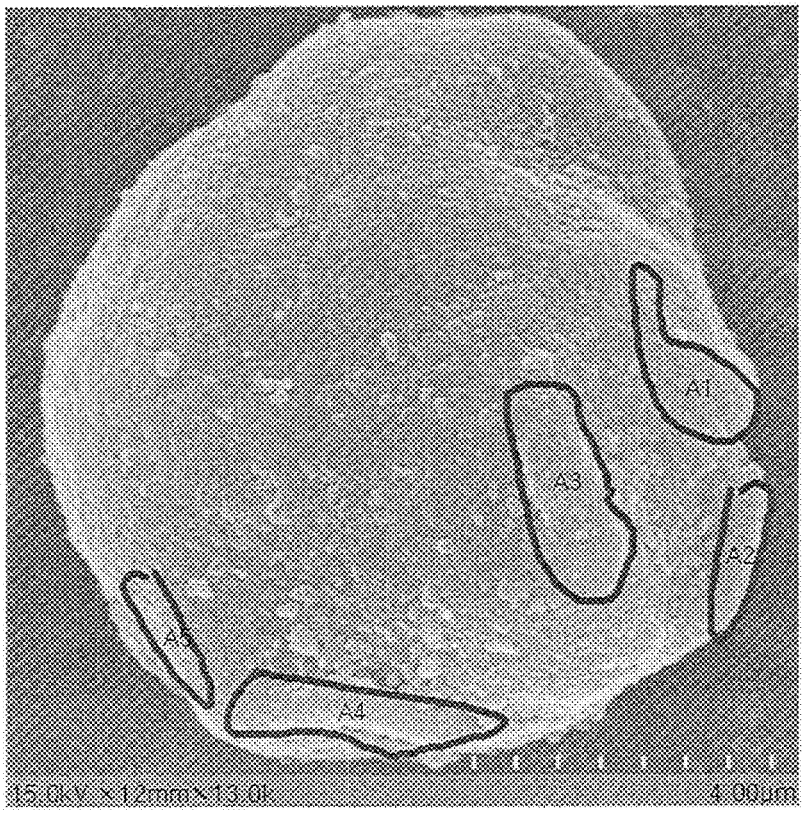
FIG. 3 is a SEM image of a toner according to another embodiment of the disclosure to explain how to calculate the area of a region protruding by a distance of about 100 nm of more in height from the surface of the toner (R) as a percentage of the total surface area of the toner.

FIG. 3 is an example of SEM image of a toner according to an embodiment of the disclosure for illustrating the calculation of the area of a region protruded by a distance of about 100 nm or more in height from the surface of the toner (R) as a percentage of the total surface area of the toner. Referring to FIG. 3, 6 regions protruding by a distance of about 100 nm or more in height from the surface of the toner are selected. The area of the selected protrusions (R) is calculated as follows.

$$R = \frac{A_1 + A_2 + A_3 + A4 + A_5 + A_6}{S}$$

According to an embodiment, the area of a region protruding by a distance of about 100 nm or more in height from the surface of the toner (R) may be in the range of about 5 to about 15% of the total surface area of the toner. If the rate is equal to or greater than 5%, the toner may have excellent glossiness and fixing properties such as increased in fixing areas. If the rate is equal to or less than 15%, the toner may have fluidity and durability such as charge stability. The area of a region protruding by a distance of about 100 nm or more in height from the surface of the toner (R) may be controlled, e.g., by altering a ratio of synthetic ester-based wax and low-melting point wax in the toner, by altering a weight ratio of core (first agglomerated toner)/shell (second latex), or by controlling a cooling rate during the preparation of a second agglomerated toner. This will be described in greater detail later.

The properties of the toner may be optimized using a metal salt including Si and Fe as an agglomerating agent. In this regard, the toner may include about 3 to about 100,000 ppm of each of Si and Fe. If the concentration of Si and Fe is equal to or greater than 3 ppm, agglomerating effects may be sufficient. If the concentration of Si and Fe is equal to or less than 100,000 ppm, the toner may have excellent charge properties. The molar ratio of Si and Fe (Si/Fe) may be in the range of about 0.15 to about 3, for example about 0.25 to about 0.75. If the molar ratio of Si and Fe is greater than 0.25, agglomerating effects may be sufficient. If the molar ratio of Si and Fe is less than 0.75, the toner may have excellent charge properties.

In addition, fine-particle toner may be prepared by using a metal salt including Si and Fe as an agglomerating agent in the manufacture of toner, and particle size of the toner may be uniformly regulated. Accordingly, an average particle size of the toner is in the range of about 3 to about 8 μm, an average sphericity of the toner is in the range of about 0.940 to about 0.970, a GSDv value may be 1.25 or less, and a GSDp value may be 1.25 or less.

The toner may have an onset temperature ranging from about 57 to about 61° C., a glass transition temperature (Tg) ranging from about 60 to about 65° C., and a heat capacity (ΔCp) ranging from about 10 to about 25 j/g ° C. when the electrophotographic toner is analyzed using a differential scanning calorimeter (DSC).

In the DSC, the onset temperature indicates a temperature in which phase of a polymer starts to change. If the onset temperature is equal to or greater than 57° C., the toner may have excellent durability. If the onset temperature is equal to or less than 61° C., the toner may have excellent fixing properties. In addition, if the glass transition temperature (Tg) is equal to or greater than 60° C., the toner may have excellent durability. If the glass transition temperature (Tg) is equal to or less than 65° C., the toner may have excellent fixing properties. If the heat capacity is equal to or greater than 10 j/g ° C., the toner may have excellent durability. If the heat capacity is equal to or less than 25 j/g ° C., the toner may have excellent fixing properties.

In the gel chromatography (GPC), the toner may have a weight average molecular weight (Mw) ranging from about 60,000 to about 75,000. If the weight average molecular weight (Mw) of the toner is equal to or greater than 65,000, durability of the toner may increase to prevent cracking at high temperature. On the other hand, if the weight average molecular weight (Mw) of the toner is equal to or less than 75,000, the toner may have excellent fixing properties.

In a solvent of the gel chromatography (GPC), the amount of a component insoluble in tetrahydrofuran (THF) may be in the range of about 18 to about 33% by weight. The insoluble component indicates a cross-linked portion of the toner. If the amount of the insoluble component is equal to or greater than 18%, the toner may have excellent durability. If the amount of the insoluble component is equal to or less than 33% by weight, the toner may have excellent fixing properties.

According to another embodiment of the disclosure, there is provided a method of preparing an electrophotographic toner. The method may include: preparing a mixture by mixing first latex particles including a wax with a pigment dispersion; preparing a first agglomerated toner by adding an agglomerating agent to the mixture; and preparing a second agglomerated toner by coating a second latex on the first agglomerated toner, wherein the area of a region protruding by a distance of about 100 nm or more in height from the surface of the toner (R) is in the range of about 5 to about 15% of the total surface area of the toner when an image projection plane of the toner is analyzed using a scanning electron microscope (SEM).

According to an embodiment, the first latex may be a polyester, a polymer obtained by polymerizing one or more polymerizable monomers, or any mixtures of the polyester and the polymer (a hybrid type). If desired, a multifunctional agent such as a bifunctional or trifunctional agent may be used as a cross-linking agent. The multifunctional agent may be divinyl benzene, trimethylopropane triacrylate, pentaerytritol triacrylate, pentaerytritol tetraacrylate, or the like. If a polymer is used as the first latex, the polymerizable monomers may be polymerized with a wax, or a wax may be added to the polymer. The first latex may be prepared by emulsion polymerization and may have a particle size of about 1 μm or less, for example, in the range of about 100 to about 300 nm.

The polymerizable monomers may include at least one monomer selected from styrene-based monomers such as styrene, vinyl toluene and a-methyl styrene; acrylic acid or methacrylic acid; derivatives of (metha)acrylates such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and metacryl amide; ethylenically unsaturated monoolefins such as ethylene, propylene and butylenes; halogenized vinyls such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen-containing vinyl compounds such as 2-vinylpyridine, 4-vinylpyridine and N-vinyl pyrrolidone.

The wax used in the process of preparing the first latex functions to allow the toner to be fixed to a final image receptor at a low temperature, and has excellent durability and wear resistance of a final image. Examples of the wax are polyethylene-based wax, propylene-based wax, silicon wax, paraffin-based wax, ester-based wax, carbauna wax, metallocene wax, and any mixtures thereof. The amount of the wax may be in the range of about 1 to about 20 parts by weight based on 100 parts by weight of the polymerizable monomers used to prepare the first latex.

In general, viscosity may be decreased while melting the toner in order to increase fixing properties and glossiness of oil-free fixing toner, and viscosity may be increased in order to increase fluidity or thermal stability of the oil-free fixing toner. That is, in order to obtain excellent fixing properties and durability of toner, the cross-linking agent may be controlled and the viscosity of the toner may be optimized. If compatibility with a resin is too high by using a low-melting point/low-viscosity wax to increase glossiness, the wax dispersed in the toner becomes fluidic during the coalescence at a temperature greater than the melting point after the agglomeration of the toner, and thus the wax is exposed on the surface of the toner. Accordingly, the toner may have unstable charging properties, poor thermal stability, poor fluidity, etc. On the other hand, if compatibility with a resin is too low, the toner may have poor fixing properties, e.g., forming stains.

The wax may be a mixture of a synthetic ester-based wax and a low-melting point wax, or an ester group-containing low-melting point wax. The synthetic ester-based wax may be an ester of a C15-C30 fatty acid and a C1-C5 alcohol, such as behenic acid behenyl ester, stearic acid stearyl ester, pentaerythritol stearic acid ester, and montanic acid glyceride. An ester may be formed using a monohydric alcohol such as a C10-C30 alcohol, or a polyhydric alcohol such as a C3-C10 alcohol. The low-melting point wax may be a low molecular weight polyolefin such as low molecular weight polyethylene, low molecular weight polypropylene, or low molecular weight polybutylene. The low-melting point wax may also be paraffin wax.

For example, wax having compositions shown in Table 1 below may be used.

TABLE 1

| Release agent | P280(ref) | P212 | P419 | P420 |
|---|---|---|---|---|
| Paraffin-based wax | 25-35% | 25-35% | 20-30% | 25-35% |
| Synthetic ester-based wax | 5-10% | 15-20% | 10-20% | 5-10% |
| | | | large | medium |
| Viscosity (mPa * s/25° C.) | 10 | | 18 | 13 |
| Melting point (DSC) | 85° C. | | 88° C. | 89° C. |

When the mixture of the synthetic ester-based wax with the low-melting point wax is used, the weight ratio of the synthetic ester-based wax to the low-melting point wax may be in the range of 1:1 to 1:7. In this weight range, the area of a region protruding by a distance of about 100 nm or more in height from the surface of the toner (R) as a percentage of the total surface area of the toner, as an index to calculate the amount of wax exposed on the surface of the toner, may be in the range of about 5 to about 15%. Accordingly, the toner may have excellent fixing properties and durability by controlling the amount of the wax exposed on the surface of the toner by optimizing the weight ratio of the synthetic ester-based wax to the low-melting point wax.

During the preparation of the first latex, an initiator for polymerization and a chain transfer agent may be used for efficient polymerization.

Examples of the initiator for polymerization are persulfate salts may include, but are not limited to potassium persulfate, and ammonium persulfate; azo compounds such as 4,4-azobis(4-cyano valeric acid), dimethyl-2,2'-azobis(2-methyl propionate), 2,2-azobis(2-amidinopropane)dihydrochloride, 2,2-azobis-2-methyl-N-1, 1-bis(hydroxymethyl)-2-hydroxyethylpropioamide, 2,2'-azobis(2,4-dimethyl valeronitrile), 2,2'-azobis isobutyronitrile, and 1,1'-azobis(1-cyclohexanecarbonitrile); and peroxides such as methyl ethyl peroxide, di-t-butylperoxide, acetyl peroxide, dicumyl peroxide, lauroyl peroxide, benzoyl peroxide, t-butylperoxy-2-ethyl hexanoate, di-isopropyl peroxydicarbonate, and di-t-butylperoxy isophthalate. Also, an oxidization-reduction initiator in which the polymerization initiator and a reduction agent are combined may be used.

Examples of the chain transfer agent include sulfur-containing compounds may include, but are not limited to dodecanthiol, thioglycolic acid, thioacetic acid, and mercaptoethanol; phosphorous acid compounds such as phosphorous acid and sodium phosphite; hypophosphorous acid compounds such as hypophosphorous acid and sodium hypophosphite; and alcohols such as methyl alcohol, ethyl alcohol, isopropyl alcohol, and n-butyl alcohol, but are not limited thereto.

The first latex may further include a charge control agent. The charge control agent used herein may be a negative charge-type charge control agent or a positive charge-type charge control agent. The negative charge-type charge control agent may be an organic metal complex or a chelate compound such as an azo dye containing chromium or a mono azo metal complex; a salicylic acid compound containing metal such as chromium, iron and zinc; or an organic metal complex of an aromatic hydroxycarboxylic acid and an aromatic dicarboxylic acid. Moreover, any known charge control agent may be used without limitation. The positive charge-type charge control agent may be a modified product such as nigrosine or a fatty acid metal salt thereof, or an onium salt including a quaternary ammonium salt such as tributylammonium 1-hydroxy-4-naphthosulfonate or tetrabutylammonium tetrafluoro borate. The positive charge-type charge control agent may be used alone or in combination of at least two. Since the charge control agent stably supports toner on a developing roller by electrostatic force, charging may be performed stably and quickly using the charge control agent.

The prepared first latex may be mixed with a pigment dispersion. The pigment dispersion can be prepared by homogeneously dispersing a composition including pigments such as black, cyan, magenta and yellow and an emulsifier using a ultrasonic processor, micro fluidizer, or the like.

Carbon black or aniline black may be used as the pigment for a black toner, and for color toner, at least one of yellow, magenta and cyan pigments are further included.

A condensation nitrogen compound, an isoindolinone compound, an anthraquine compound, an azo metal complex or an allyl imide compound can be used as the yellow pigment. In particular, C.I. pigment yellow 12, 13, 14, 17, 62, 74, 83, 93, 94, 95, 109, 110, 111, 128, 129, 147, 168, 180, or the like can be used.

A condensation nitrogen compound, an anthraquine compound, a quinacridone compound, a base dye lake compound, a naphthol compound, a benzo imidazole compound, a thioindigo compound or a perylene compound can be used as the magenta pigment. In particular, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like can be used.

A copper phthalocyanine compound and derivatives thereof, an anthraquine compound, or a base dye lake compound can be used as the cyan pigment. In particular, C.I. pigment blue 1, 7, 15, 15:1, 15:2, 15:3, 15:4, 60, 62, 66, or the like can be used.

Such pigments can be used alone or in a combination of at least two pigments, and are selected in consideration of color, chromacity, luminance, resistance to weather, dispersion capability in toner, etc.

The amount of the pigment as described above may be sufficient to color the toner. For example, the amount of the pigment may be in the range of about 0.1 to about 20 parts by weight based on 100 parts by weight of the polymerizable monomers.

Any emulsifier that is known in the art may be used as the emulsifier used in the pigment dispersion. In this regard, an anionic reactive emulsifier, a nonionic reactive emulsifier or a mixture thereof can be used. The anionic reactive emulsifier may be HS-10 (Dai-ich kogyo, Co., Ltd.), Dawfax 2-A1 (Rhodia Inc.), etc., and the nonionic reactive emulsifier may be RN-10 (Dai-ichi kogyo, Co., Ltd.).

The wax, the first latex, and the pigment dispersion are mixed, and then an agglomerating agent is added to the mixture to prepare a first agglomerated toner (core). More particularly, when the wax, the first latex particles, and the pigment dispersion are mixed using a homogenizer, the agglomerating agent is added thereto, and the resultant is maintained at a temperature ranging from about 25 to about 60° C. (less than Tg), for example, from about 35 to about 55° C. to prepare a first agglomerated toner. Then, the resultant is coalesced at a temperature ranging from about 85 to about 100° C. (about 30 to about 50° C. higher than Tg) to prepare a second agglomerated toner having a particle size of about 5 to about 7 μm. If desired, the first agglomerated toner may further be coated by adding a latex (third latex) for shells. In this regard, acid values of the wax, the first latex, and the second latex are as follows: wax<first latex<second latex. The acid values of the first latex and the second latex are in the range of 5 to 10.

The size of the first agglomerated toner is increased by ionic strength increased by the addition of the metal salt including Si and Fe and collisions between the particles during the method of manufacturing the toner. An example of the metal salt including Fe and Si may be polysilica iron (Model Nos. PSI-025, PSI-050 and PSI-075, manufactured by Suido Kiko Co.). Physical properties and compositions of Model Nos. PSI-025, PSI-050 and PSI-075 are listed in Table 2 below. Since the metal salt agglomerating agent has very strong agglomerating forces with a small amount at low temperature, a rhodamine pigment, which does not easily agglomerate, may be used. In particular, risks of aluminum contained in conventional agglomerating agents to humans and the environment may be prevented since Fe and Si are used as main components.

TABLE 2

| | PSI-025 | PSI-050 | PSI-075 |
|---|---|---|---|
| Silica/Fe molar ratio (Si/Fe) | 0.25 | 0.5 | 0.85 |
| concentration Fe(wt %) | 5.0 | 3.5 | 2.5 |
| SiO2(wt %) | 1.4 | 1.9 | 2.0 |
| pH (1 w/v %) | | 2-3 | |
| Specific gravity (20° C.) | 1.14 | 1.13 | 1.09 |
| Viscosity (mPa · S) | | 2.0 or greater | |
| Average molecular weight (Dalton) | | 500,000 | |
| Appearance | | Yellowish brown transparent liquid | |

| Type | PSI-100 | PSI-200 | PSI-300 |
|---|---|---|---|
| Silica/Fe molar ratio (Si/Fe) | 1 | 2 | 3 |
| concentration Fe(wt %) | 2.0 | 1.0 | 0.8 |
| SiO2(wt %) | 2.2 | 2.2 | 2.2 |
| pH (1 w/v %) | | 2-3 | |
| Specific gravity (20° C.) | 1.08 | 1.06 | 1.04 |
| Viscosity (mPa · S) | | 2.0 or greater | |
| Average molecular weight (Dalton) | | 500,000 | |
| Appearance | | Yellowish brown transparent liquid | |

The preparation of the second agglomerated toner may include: coating the second latex on the first agglomerated toner and adjusting the pH of the mixture to about 6 to about 8; heating the resultant to a temperature ranging from about 85 to about 100° C. and adjusting the pH of the resultant to about 5 to about 6; and cooling the resultant at a rate ranging from 0.5 to 2° C./min.

The second latex may be prepared by polymerizing the one or more polymerizable monomers used to prepare the first latex. The second latex may be prepared by emulsion polymerization and has a particle size of 1 μm or less, for example, in the range of about 100 to about 300 nm. The second latex may also include a release agent, and the release agent may be added to the second latex during the polymerization.

The amount of the wax exposed on the surface of the toner may be controlled by regulating the weight ratio of a core (first agglomerated toner) to a shell (second latex) by changing the weight ratio of the first latex to the second latex. For example, the amount of the second latex may be controlled such that the weight ratio of the core to the shell is in the range of 15:2 to 3:1. Since the area of a region protruding by a distance of about 100 nm or more in height from the surface of the toner (R) as a percentage of the total surface area of the toner is in the range of about 5 to about 15%, the toner may have excellent fixing properties and durability.

The cooling rate during the preparation of the second agglomerated toner may be in the range of 0.5 to 2° C./min. If the cooling rate is greater than 2° C./min, the amount of the wax exposed on the surface of the toner may be greater than 15%. If the cooling rate is less than, 0.5° C./min, the amount of the wax exposed on the surface of the toner may be less than 5%. Accordingly, toner having excellent fixing properties and durability may be prepared by controlling the cooling rate.

Meanwhile, a third latex prepared by polymerizing at least one polymerizable monomer may be coated on the second agglomerated toner.

By forming a shell layer with the second latex or the third latex, durability can be improved, and problems with storage of toner during shipping and handling can be overcome. Here, a polymerization inhibitor can be added in order to prevent new latex particles from being formed, or the reaction can be performed using a starved-feeding process to facilitate coating of the monomer mixture on the toner.

The prepared second agglomerated toner or third agglomerated toner is filtered to separate toner particles and the toner particles are dried. The dried toner particles are subject to a surface-treatment process using external additives, and charge amount is controlled to prepare a final dry toner.

The external additives may be silica, $TiO_2$, or the like. The amount of the external additives may be in the range of about 1.5 to about 4 parts by weight, for example, about 2 to about 3 parts by weight, based on 100 parts by weight of the toner before being surface treated using the external additives. If the amount of the external additives is less than 1.5 parts by weight, caking, by which toner particles agglomerate due to agglomerating forces, may occur, and the charge amount is unstable. If the amount of the external additives is greater than 4 parts by weight, an excess amount of external additives may contaminate the roller.

According to another embodiment of the disclosure, there is provided a toner supplying unit including: a toner tank storing a developer including the electrophotographic toner; a supplying part projecting inside the toner tank to discharge the toner from the toner tank; and a toner agitating member rotatably disposed inside the toner tank to agitate the toner in almost an entire inner space of the toner tank including a location on a top surface of the supplying part.

Figure 4:
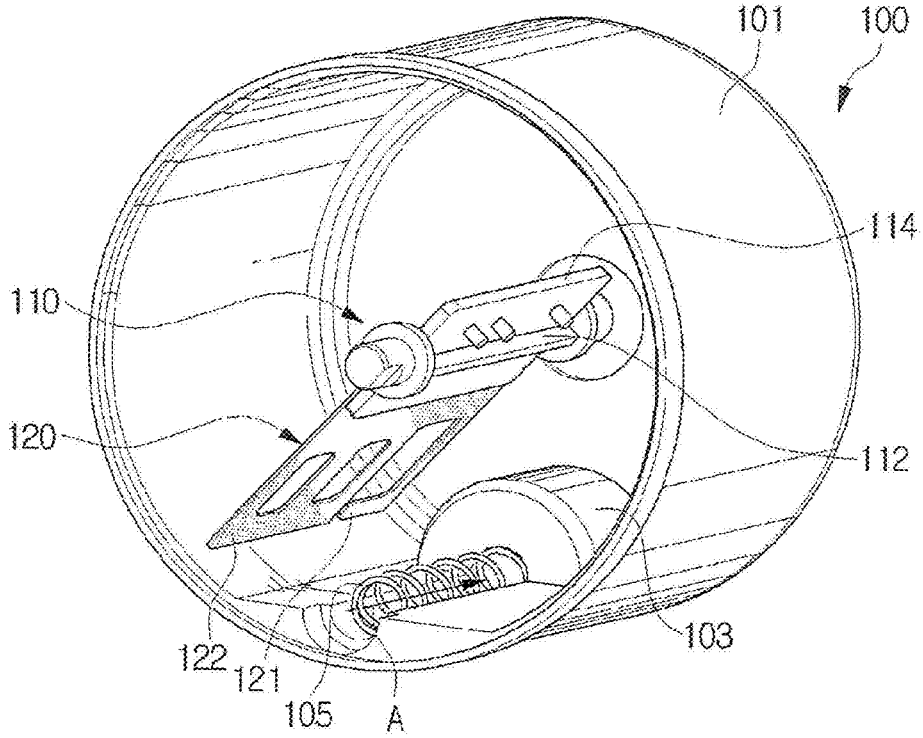
FIG. 4 is a schematic perspective view of a toner supplying unit according to another embodiment of the disclosure.

FIG. 4 is a schematic perspective view of a toner supplying unit according to an embodiment of the disclosure.

Referring to FIG. 4, the toner supplying unit 100 according to the present embodiment includes a toner tank 101, a supply unit 103, a toner transporting member 105, and a toner agitating member 110.

The toner tank 101 stores a developer including a selected amount of toner and has a hollow cylindrical shape.

The supply unit 103 is installed in a lower portion of the toner tank 101 and discharges toner stored in the toner tank 101 to outside of the toner tank. That is, the supply unit 103 protrudes from a lower inner surface of the toner tank 101 to the inside of the toner tank 101 to have a pillar shape with a semicircular cross-section. The external surface of the supply unit 103 has outlets for discharging toner (not shown).

The toner transporting member 105 is installed in the lower portion of the toner tank 101 and on a side of the supply unit 103. The toner transporting member 105 has a coil spring shape, and one end of the toner transporting member 105 extends to the inside of the supply unit 103. Thus, if the toner transporting member 105 rotates, toner in the toner tank 101 is transported to the inside of the supply unit 103. The toner transported by the toner transporting member 105 is discharged from the supply unit 103 through the outlets.

The toner agitating member 110 is installed in the toner tank 101 so as to rotate, and toner stored in the toner tank 101 is transported to the lower portion of the toner tank 101 by the toner agitating member 110. That is, if the toner agitating member 110 rotates at the center of the toner tank 101, toner stored in the toner tank 101 is agitated, and thus, the toner is not solidified. In this regard, the toner is agitated by the toner agitating member 110 and moves to the lower portion of the toner tank 101. The toner agitating member 110 includes a rotating axis 112 and a toner agitating film 120. The rotating axis 112 is installed at the center of the toner tank 101 so as to rotate. A driving gear (not shown) is installed on a moving axis of one protruding end of the toner tank 101. Accordingly, if the driving gear rotates, the rotating axis 112 rotates. In addition, a wing 114 may be installed on the rotating axis 112 to facilitate the installation of the toner agitating film 120. In this regard, the wing 114 may be symmetrically formed about the rotating axis 112. The toner agitating film 120 has a width corresponding to an inner length of the toner tank 101 and elasticity so as to be transformed according to the protrusion of the toner tank 101, i.e., the supply unit 103.

The toner agitating film 120 may have a first agitating unit 121 and a second agitating unit 122 by dividing the toner agitating film 120 in the length direction of the rotating axis 112.

According to another embodiment of the disclosure, there is provided an image forming apparatus including: an image carrier; an image forming unit that forms an electrostatic latent image on a surface of an image carrier; a unit receiving a developer including the toner; a toner supplying unit that supplies the toner onto the surface of the image carrier to develop the electrostatic latent image on the surface of the image carrier into a toner image; and a developer transferring unit that transfers the toner image to a transfer medium from the surface of the image carrier. The toner is an electrophotographic toner including a latex, a coloring agent, and a release agent, wherein the area of a region protruding by a distance of about 100 nm or more in height from the surface of the toner (R) is in the range of about 5 to about 15% of the total surface area of the toner when an image projection plane of the electrophotographic toner is analyzed using a scanning electron microscope (SEM).

Figure 5:
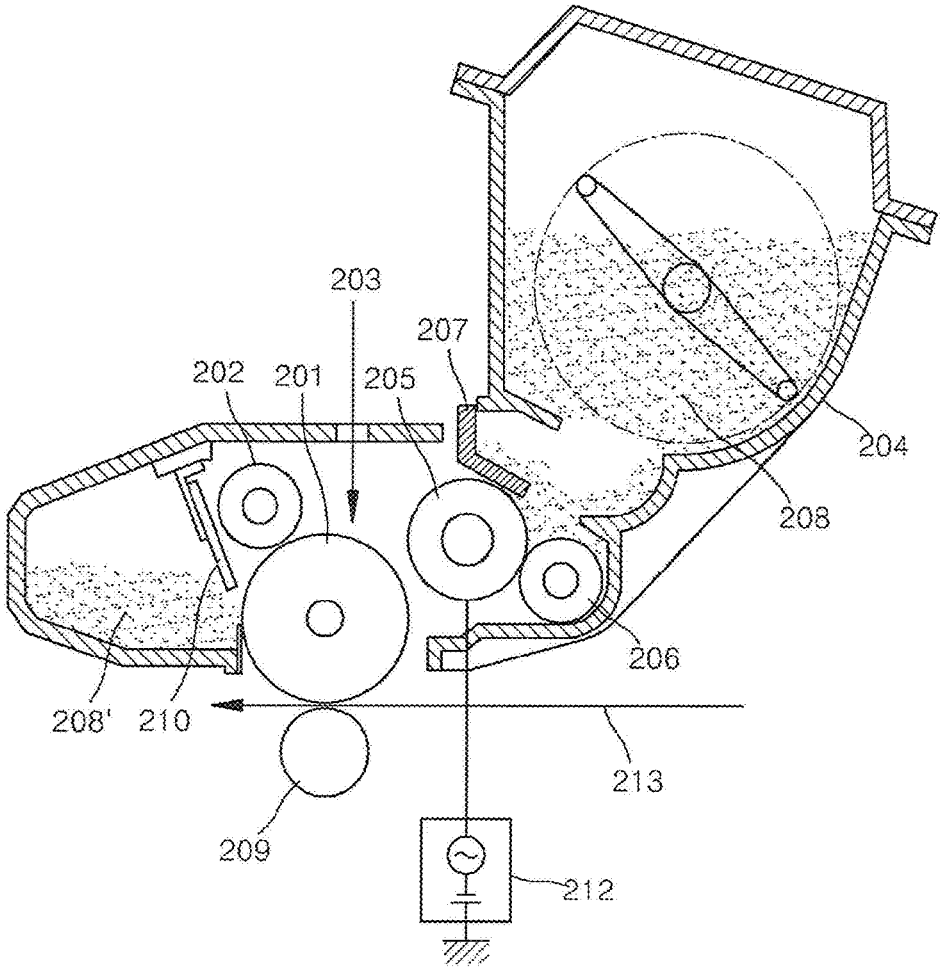
FIG. 5 is a sectional view of an image forming apparatus employing a developer including a toner prepared according to an embodiment of the disclosure.

FIG. 5 is a sectional view of a non-contact developing type image forming apparatus according to an embodiment of the disclosure. The non-contact developing type image forming apparatus of FIG. 5 employs a developer including the toner according to the disclosure.

Referring to FIG. 5, the developer, which is a nonmagnetic one-component developer of a developing unit 204, and which is supplied to a developing roller 205 through a feeding roller 206 formed of an elastic material such as a polyurethane foam or sponge. The developer 208 supplied to the developing roller 205 reaches a contact point between the developing roller 205 and a developer regulation blade 207 as the developing roller 205 rotates. The developer regulation blade 207 is formed of an elastic material such as an elastic metal or rubber. When the developer 208 passes the contact point between the developing roller 205 and the developer regulation blade 207, the developer 208 is smoothed to form a thin layer that is sufficiently charged. The developing roller 205 transfers the thin layer of the developer 208 to a developing domain where the thin layer of the developer 208 is developed on an electrostatic latent image of a image carrier 201 constituting a latent image carrier. The electrostatic latent image is formed by scanning light 203 onto the image carrier 201.

The developing roller 205 and the image carrier 201 face each other with a constant distance therebetween. The developing roller 205 rotates in a counterclockwise direction and the image carrier 201 rotates in a clockwise direction.

The developer 208 transferred to the developing domain of the image carrier 201 forms a toner image by developing an electrostatic latent image on the image carrier 201 according to the intensity of the electric charge generated due to a difference between an AC voltage superposed with a DC voltage applied to the developing roller 205 and a latent image potential of the image carrier 201 that is charged by a charging unit 202.

The developer 208 developed on the image carrier 201 is transferred to a transferring means 209 as the photoreceptor 201 rotates. The developer 208 developed on the image carrier 201 is transferred to a sheet of paper 213 by corona discharge or a roller to which a high voltage having inverse polarity of the developer 208 is applied as the paper 213 contacts the developer 208 developed on the image carrier 201, and thus an image is formed.

The image transferred to the printing paper 213 passes through a fixing device (not shown) that applies high temperature and high pressure, and the image is fused to the printing paper 213 as the developer 208 is transferred to the printing paper 213. Meanwhile, the developer 208' remaining on the developing roller 205 and which is not developed is transferred back to the feeding roller 206 contacting the developing roller 205. Remaining developer 8' that is undeveloped on the image carrier 201 is collected by a cleaning blade 210. The above processes are repeated.

Aspect of the disclosure will now be described in more detail with reference to the examples below, but is not limited thereto. The following examples are for illustrative purposes only and are not intended to limit the scope of the disclosure.

Example 1

Synthesis of Latex

A monomer dispersion is prepared as follows. A monomer mixture including 234 g of styrene, 96 g of n-butyl acrylate, 14 g of methacrylic acid, and 6.5 g of poly(ethylene glycol)-ethyl ether methacraylate was added to a 3 L beaker. 2 g of ADOD, as a cross-linking agent, and 5 g of dodecane tiol, as a chain transfer agent (CTA) were added thereto. The monomer mixture was emulsified by adding 500 g of HS-10 solution (0-4%) for 2 hours.

Figure 1:
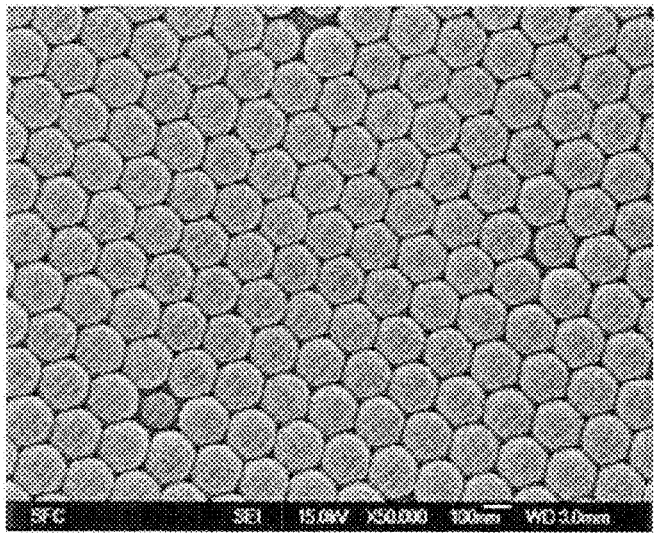
FIG. 1 is a scanning electron microscope (SEM) image of a first latex used to prepare a toner according to an embodiment of the disclosure.

The monomer emulsion was added to a reactor heated to 80° C., and 100 g of 3.2% KPS aqueous solution, as an initiator, was added thereto. The resultant was purged with nitrogen gas for 2 hours, further reacted for 6 hours, and naturally cooled. After the reaction, the particle size of the first latex, which was measured using a light scattering method using a Horiba 910, was 180 nm. The first latex had a weight average molecular weight (Mw) of 68,000 measured using GPC and a gel content of 2.5%. FIG. 1 is a SEM image of the first latex.

Preparation of Pigment Dispersion 10 of a mixture of an anionic reactive emulsifier (HS-10; Dai-ich kogyo, Co., Ltd.) and a nonionic reactive emulsifier (RN-10; Dai-ich kogyo, Co., Ltd.) in weight ratios shown in Table 2 below, 60 g of pigment (black, cyan, magenta, and yellow), and 400 g of glass beads having a diameter of 0.8-1 mm were added to a milling bath. Then, the mixture was milled at room temperature to prepare a dispersion using an ultrasonic homogenizer or a micro fluidizer.

| Color | Pigment | HS-10:RN-10 (weight ratio) | Particle size |
|---|---|---|---|
| Black | Mogul-L | 100:0 | 130 nm |
| | | 80:20 | 120 nm |
| | | 0:100 | 100 nm |
| Yellow | PY-74 | 100:0 | 350 nm |
| | | 50:50 | 290 nm |
| | | 0:100 | 280 nm |
| Magenta | PR-122 | 100:0 | 320 nm |
| | | 50:50 | 300 nm |
| | | 0:100 | 290 nm |
| Cyan | PB 15:3 | 100:0 | 130 nm |
| | | 80:20 | 120 nm |
| | | 80:30 | 120 nm |

Agglomeration and Preparation of Toner 500 g deionized water, 150 g of the first latex, 35 g of the cyan pigment dispersion (HS-10 100%), and 28 g of a wax dispersion P-420 (Chukyo Yushi Co., Ltd.) were added to a 1 L reactor. 15 g of a mixture of nitric acid (0.3 mol) and PSI (Suiki Co. PSI HM 100) was added to the reactor. The mixture was stirred at 11,000 rpm for 6 minutes using a homogenizer to prepare agglomerated particles having a diameter of 1.5 to 2.5 μm. The resultant was added to a 1 L double-jacketed reactor, and heated from room temperature to 50° C. (Tg of the latex-5° C.) at a rate of 0.5° C. per minute. When a volume average diameter (D50) of the particles reached about 6.0 μm, and 2% of the toner particles had a volume average diameter of 3 μm, 50 g of the second latex was further added thereto. When the volume average diameter (D50) of the particles reached about 6.2 μm, NaOH (1 mol) was added thereto to adjust the pH to 7. When the D 50 of the particles was constantly maintained for 10 minutes, the temperature was increased to 96° C. at a rate of 1° C./min. When the temperature reached 96° C., 0.3 mol of nitric acid was added thereto to adjust the pH to 5.8. Then, the resultant was agglomerated for 3-5 hours to obtain a potato-shaped toner having a particle diameter of 6 to 6.5 μm. Then, the second agglomerated toner was cooled to a temperature lower than Tg, filtered to be separated, and dried. The dried toner particles were subjected to a surface treatment by adding 0.5 parts by weight of NX-90 (Nippon Aerosil), 1.0 parts by weight of RX-200 (Nippon Aerosil), and 0.5 parts by weight of SW-100 (Titan Kogyo), and the mixture was stirred in a mixer (KM-LS2K, Dae Hwa Tech Co., Ltd.) at 8,000 rpm for 4 minutes. As a result, toner having a D50 of 6.2 μm was obtained.

Figure 2A:
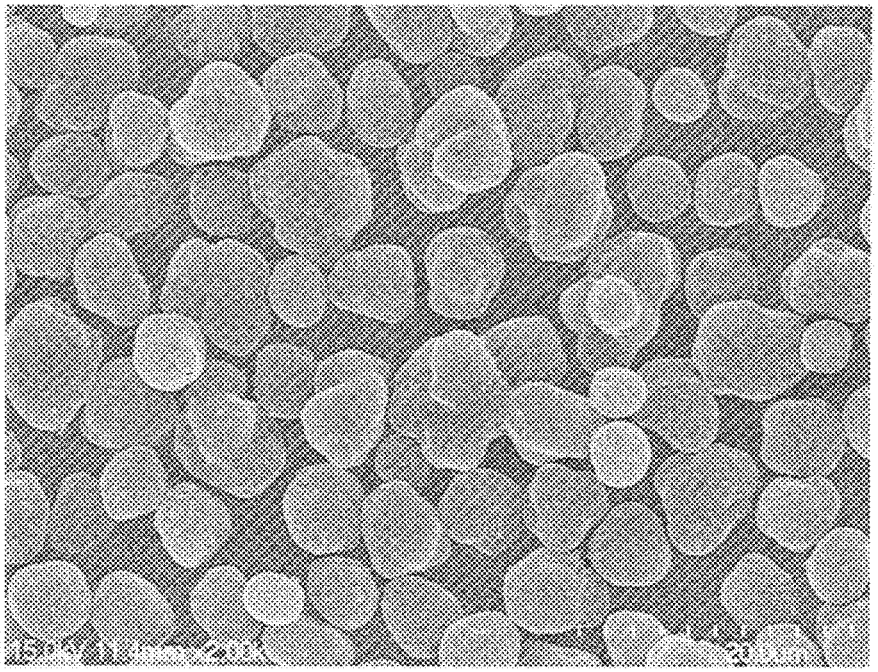
FIGS. 2A and 2B are SEM images of a toner according to another embodiment of the disclosure.
Figure 2B:
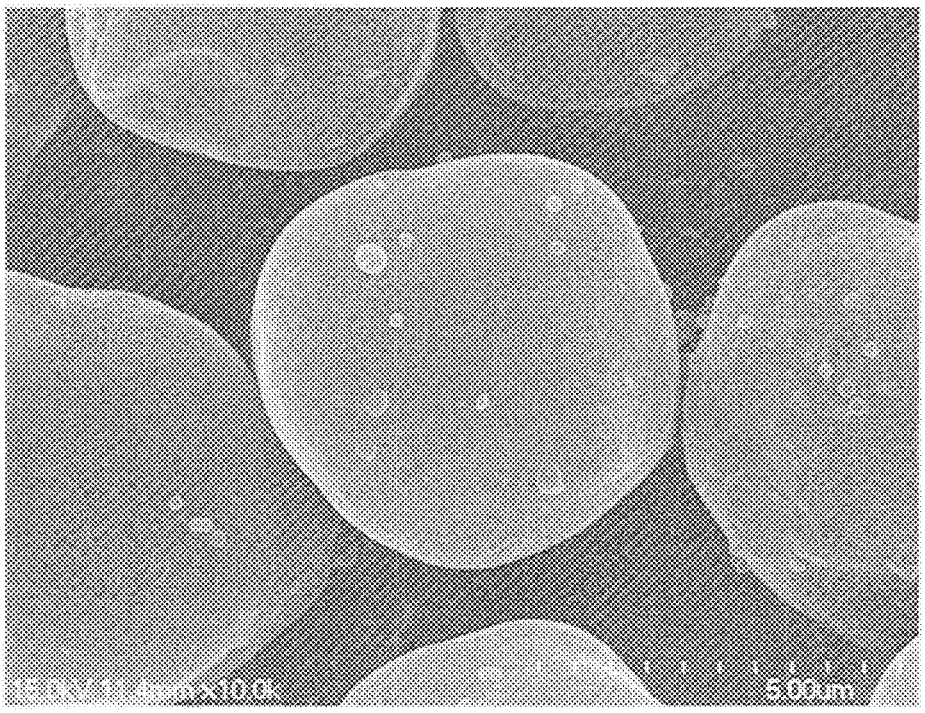

The toner had a Tg of 62.8° C., a weight average molecular weight (Mw) of 68,000, and a gel content of 19%. The content of the wax exposed on the surface of the toner measured using a component insoluble in TI-IF was 8.2%. FIGS. 2A and 2B are SEM images of the toner.

Example 2

Toner was prepared in the same manner as in Example 1, except that the weight ratio of the core/shell was in the range of 72/28 to 68/32 by adding 135 g of the first latex and 65 g of the second latex.

The toner had a Tg of 62.6° C., a weight average molecular weight (Mw) of 68,000, and a gel content of 20.3%. The content of the wax exposed on the surface of the toner measured using SEM was 6.3% of the total surface area of the toner.

Example 3

Toner was prepared in the same manner as in Example 1, except that the cooling rate was changed from 1° C./min to 2° C./min during agglomeration.

The toner had a Tg of 62.6° C., a weight average molecular weight (Mw) of 68,000, and a gel content of 20.3%. The content of the wax exposed on the surface of the toner measured using SEM was 9.7% of the total surface area of the toner.

Comparative Example 1

Toner was prepared in the same manner as in Example 1, except that 10 g of the second latex was used instead of 50 g.

Comparative Example 2

Toner was prepared in the same manner as in Example 1, except that the second latex was not added.

Comparative Example 3

Toner was prepared in the same manner as in Example 1, except that P220 was used instead of P420.

Evaluations of Toner

Analysis of Surface Area and Amount of Wax

The total surface area (S) of a toner particle was calculated from an image projection plane of the toner using SEM. Regions protruding by a distance of about 100 nm or more in height from the surface of the toner were selected, and the areas of the protruding regions (Ai) were calculated using Equation 1 above.

Evaluation of Fusing Range of Toner

Device: Belt-type fusing device

Unfixed Image for test: 100% pattern

Test temperature: 100~200° C. (10° C. interval)

Speed: 160 mm/sec

Fixing time: 0.08 sec

Tests were conducted under the conditions described above, and properties of fused images were evaluated as follows.

Optical density (OD) of a fused image was measured. 3M 810 tape was attached to the image and the tape was rubbed 5 times using a 500 g weight. After the tape was removed, OD of the image was measured.

$$\text{Fixation rate}(\%)=(\text{OD of image after removing tape}/\text{OD of image before removing tape})\times 100$$

A region having a fixation rate greater than 90% is regarded as the fusing range of toner.

MFT: minimum fusing temperature [minimum temperature exhibiting a fixation rate greater than 90% without cold-offset]

HOT: hot offset temperature [minimum temperature at which hot-offset occurs]

Evaluation of Glossiness

Glossiness was measured using a glossmeter (manufactured by BYK Gardner, Model No.: micro-TRI-gloss) at the fixing temperature of 160° C.

Angle: 60°

Pattern: 100% pattern

Evaluation of Storage Properties at High Temperature 100 g of toner was subjected to surface treatment, supplied to a developing device (manufactured by Samsung Electronics, Co., Ltd., Model No.: color laser 660), sealed, and stored in a constant temperature-humidity oven under conditions as follows 23° C., 55% RH (Relative Humidity) 2 hr ⇒ 40° C., 90% RH 48 hr ⇒ 50° C., 80% RH 48 hr ⇒ 40° C., 90% RH 48 hr ⇒ 23° C., 55% RH 6 hr After the toner was stored, caking of toner in the developing device was observed with the naked eye, and 100% images were printed. The quality of the images was observed, and the defects of the images were evaluated.

Reference of Evaluation

○: Good image quality, No-Caking

Δ: Poor image quality, No-Caking

X: Caking

Evaluation of Degree of Agglomeration (Carr's Cohesion)

Device: Hosokawa micron powder tester PT-S

Amount of sample: 2 g (toner untreated or treated with external additives)

Amplitude: 1 mm_dial 3~3.5

Sieve: 53, 45, 38 μm

Vibration time: 120 sec

The sample was stored at 23° C. at RH 55% for 2 hours, and the weight of the sample remaining in each of the sieves was measured, and the degree of agglomeration was calculated as follows.

$$[(\text{weight of sample remaining in the 53 }\mu\text{m sieve})/2\text{ g}]\times 100 \quad (1)$$

$$[(\text{weight of sample remaining in the 45 }\mu\text{m sieve})/2\text{ g}]\times 100\times(3/5) \quad (2)$$

$$[(\text{weight of sample remaining in the 38 }\mu\text{m sieve})/2\text{ g}]\times 100\times(1/5) \quad (3)$$

$$\text{Degree of agglomeration (Carr's Cohesion)}=(1)+(2)+(3)$$

Evaluation of Charging Properties 28.5 g of a carrier and 1.5 g of toner were added to a 60 ml glossy reactor, and the mixture was stirred using a turbula mixer. The amount of charged toner particles was measured using a field separation. In particular, charge stability of toner particles with respect to stirring time at room temperature and normal humidity and a ratio of charge amount of high temperature and high humidity/charge amount of low temperature and low humidity were measured.

Room temperature and normal humidity: 23° C., RH 55%

High temperature and high humidity (HH): 32° C., RH 80%

Low temperature and low humidity (LL): 10° C., RH 10%

Results of the Evaluations

The evaluation results of the toner prepared according to Examples 1 to 3 and Comparative Examples 1 to 3 are shown in Table 3 below.

TABLE 3

| | Surface wax (%) | Tg [toner] | Tm [toner] Initiation [° C.] | Tm [toner] Termination [° C.] | Glossiness | ΔCp (J/g° C.) MFT | Fixing properties | | Charging properties | | | Fluidity | High-temperature storage properties |
|---|---|---|---|---|---|---|---|---|---|---|---|---|---|
| | | | | | | | | HOT | Stability | HH/LL | | | |
| Example 1 | 8.2% | 62.8° C. | 57.8 | 64.65 | 8.9 | 16.6 | 150° C. | 210° C. | ◎ | 0.65 | ○ | ○ | ○ |
| Example 2 | 6.3% | 62.6° C. | 58.3 | 64.68 | 8.6 | 16.5 | 150° C. | 210° C. | ○ | 0.63 | ○ | ◎ | ◎ |
| Example 3 | 9.7% | 62.6° C. | 58.2 | 64.75 | 8.6 | 16.6 | 150° C. | 210° C. | ○ | 0.62 | ○ | ○ | ◎ |
| Comparative Example 1 | 16.2% | 62.7° C. | 58.6 | 64.62 | 8.7 | 16.5 | 150° C. | 200° C. | Δ | 0.48 | X | Δ | Δ |
| Comparative Example 2 | 20% | 62.7° C. | 58.4 | 64.66 | 8.8 | 16.6 | 150° C. | 210° C. | X | 0.52 | Δ | X | X |
| Comparative Example 3 | 15.8% | 62.8° C. | 58.7 | 64.67 | 8.6 | 16.4 | 160° C. | 215° C. | Δ | 0.46 | Δ | Δ | ○ |

◎: excellent,
○: good,
Δ: fair,
X: poor

Referring to Table 3, the toners prepared according to Examples 1 to 3 have better fluidity and storage properties at high temperature compared to the toners prepared according to Comparative Examples 1 to 3.

While the disclosure has been particularly shown and described with reference to exemplary embodiments thereof, it will be understood by those of ordinary skill in the art that various changes in form and details may be made therein without departing from the spirit and scope of the disclosure as defined by the following claims.

What is claimed is:

1. An electrophotographic toner comprising a latex, a coloring agent and a release agent, wherein the area of a region protruding by a distance of about 100 nm or more in height from the surface of the toner (R) is in the range of about 5 to about 15% of the total surface area of the toner when an image projection plane of the electrophotographic toner is analyzed using a scanning electron microscope (SEM).

2. The electrophotographic toner of claim 1, further comprising about 3 to about 1,000 ppm each of Si and Fe.

3. The electrophotographic toner of claim 2, wherein the molar ratio of the Si to Fe is in the range of about 0.1 to about 5.

4. The electrophotographic toner of claim 1, having an onset temperature ranging from about 57 to about 61° C., a glass transition temperature (Tg) ranging from about 60 to about 65° C., and a heat capacity (ΔCp) ranging from about 10 to about 25 j/g ° C. when the electrophotographic toner is analyzed using a differential scanning calorimeter (DSC) method.

5. The electrophotographic toner of claim 1, having a weight average molecular weight (Mw) ranging from about 60,000 to about 75,000 when the electrophotographic toner is analyzed by gel chromatography (GPC).

6. The electrophotographic toner of claim 1, wherein the amount of an insoluble component is in the range of about 18 to about 33% by weight when the electrophotographic toner is analyzed by gel chromatography.

* * * * *